United States Patent [19]

Ferrenberg et al.

[11] Patent Number: 4,790,284

[45] Date of Patent: Dec. 13, 1988

[54] REGENERATIVE INTERNAL COMBUSTION ENGINE

[75] Inventors: Allan J. Ferrenberg, Canoga Park; William T. Webber, Agoura, both of Calif.

[73] Assignee: Regenic Corporation, Canoga Park, Calif.

[21] Appl. No.: 782,959

[22] Filed: Oct. 2, 1985

[51] Int. Cl.[4] ..... F02G 5/00

[52] U.S. Cl. ..... 123/543; 60/517

[58] Field of Search ..... 123/78 A, 543, 546, 123/550, 552; 60/515, 517, 526, 616, 619, 620, 690, 712

[56] References Cited

U.S. PATENT DOCUMENTS

| | | | |
|---|---|---|---|
| 3,777,718 | 12/1973 | Pattas | 60/517 X |
| 4,074,533 | 2/1978 | Stockton | 60/712 X |
| 4,280,468 | 7/1981 | Millman | 123/543 X |
| 4,413,475 | 11/1983 | Moscrip | 60/517 X |

*Primary Examiner*—Willis R. Wolfe, Jr.
*Attorney, Agent, or Firm*—Walter Unterberg

[57] ABSTRACT

A highly efficient regenerative reciprocating internal combustion engine is disclosed. The regenerator captures the unutilized heat normally expelled with the exhaust products of such an engine and transfers it to fresh working fluid at the appropriate time in the next engine operating cycle to reduce the quantity of fuel which must be burned, resulting in an increase in engine efficiency. This is accomplished through the use of a permeable, movable heat exchanger located between the piston and the cylinder head. This regenerative technique can be applied to both two and four stroke Diesel cycle and Otto cycle engines. It can also be employed in ported (i.e. valveless) engines. The hot combustion region can be located between the cylinder head and the regenerator or between the piston and the regenerator. These regenerative devices and processes greatly improve the thermal efficiency of conventional internal combustion engines, while providing power outputs similar to conventional engines of the same displacement, greatly reducing hydrocarbon and carbon monoxide emissions, and utilizing much the same hardware. In addition, the regenerative internal combustion engine places reduced heat loads on engine components, is operable at lower peak temperatures (with thermal efficiencies and power still comparable to conventional engines), and is better able to utilize high temperature materials which can reduce heat loss to engine cooling systems.

3 Claims, 13 Drawing Sheets

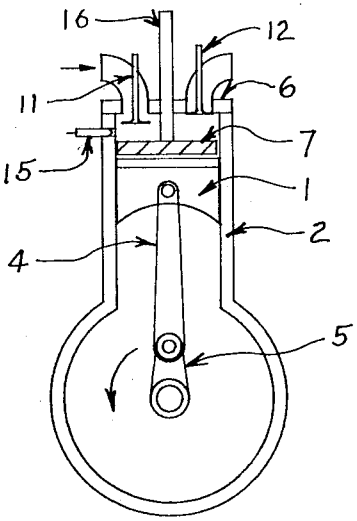
Figure 2a
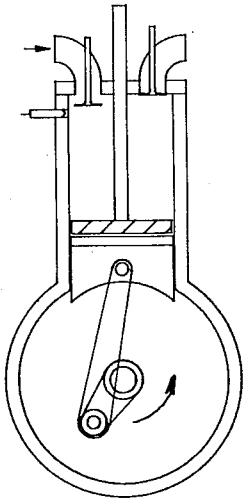
Figure 2b
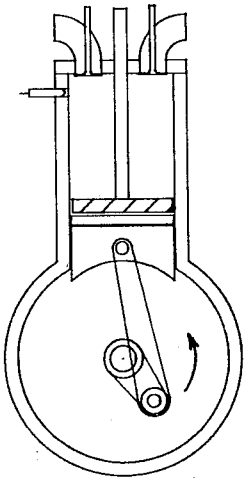
Figure 2c
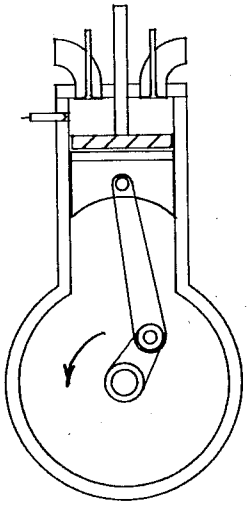
Figure 2d
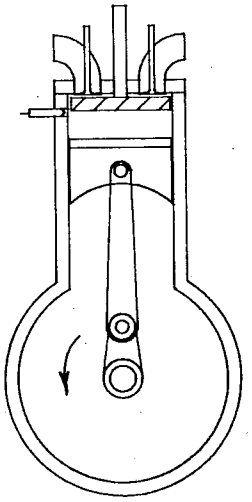
Figure 2e
Figure 2f
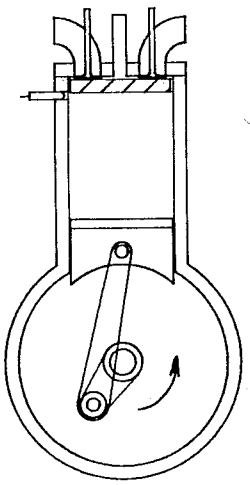
Figure 2g
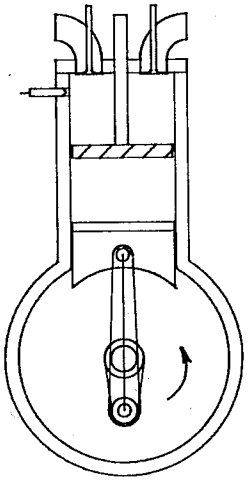
Figure 2h
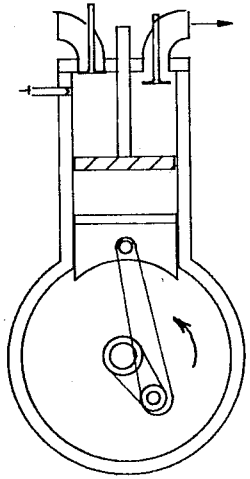
Figure 2i
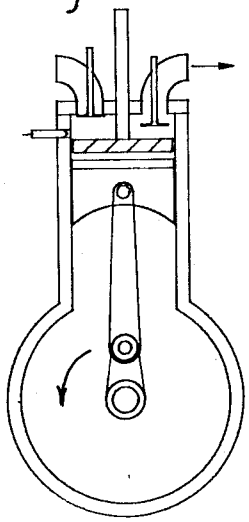
Figure 2j

REGENERATIVE INTERNAL COMBUSTION ENGINE

BACKGROUND OF THE INVENTION

1. Field of the Invention

This invention relates to internal combustion engines, and more specifically to thermally regenerated internal combustion engines.

2. Description of Prior Art

Conventional Otto and Diesel cycle piston engines operate by intaking fresh air, compressing the air, burning fuel with the air to produce high temperature, high presssure combustion products, expanding the combustion products to convert part of the heat into work, and then exhausting the spent gases. These engine cycles are relatively inefficient in converting heat into work because of the practical limitations on the extent of the compression and expansion processes. In order to operate at the highest efficiency which is theoretically possible, the hot product gases would need to be expanded until they had cooled to room temperature. However, with the thermal properties of ordinary combustion products, this would require an expansion volume ratio in excess of one thousand. Those skilled in the art will be aware that an engine with a volume expansion ratio of one thousand and a final gas pressure at or near atmospheric would require a peak pressure so high as to threaten destruction of cylinder, piston and other moving parts, and would aggravate losses from friction, heat transfer, and gas leakage.

In the past, attempts have been made to recover the residual heat energy in the exhaust gas from internal combustion engines by passing the gas through a gas turbine, but such turbines have pressure ratios far too low to convert much of the exhaust heat into work. Internal combustion engine exhaust gases have also been used as the heat source for a Rankine (steam engine) bottoming cycle, but this introduces undesirable complexity, cost and size into the engine design.

A very promising technique for substantially increasing the thermal efficiency of an internal combustion piston engine is through thermal regeneration. Thermal regeneration, as used herein, implies the capture of exhaust gas heat from one engine cycle and the transfer of this heat to the working fluid of the subsequent cycle following its compression, but prior to the combustion of the fuel, so as to reduce the required quantity of fuel to be burned. A number of attempts have been made to devise means by which regenerative features similar to those employed in a Stirling or Ericsson type engine could be used to accomplish this. Most notable of these techniques are those of Hirsch (1874, U.S. Pat. No. 155,087), Martinka (1937, U.S. Pat. No. 2,239,922), Pattas (1973, U.S. Pat. No. 3,777,718), Bland (1975, U.S. Pat. No. 3,871,179), Pfefferle (1975, U.S. Pat. No. 3,923,011), Cowans (1977, U.S. Pat. No. 4,004,421), and Stockton (1978, U.S. Pat. No. 4,074,533).

The Hirsch, Martinka, Pattas and Stockton engines all employ multiple cylinders and pistons for each working unit to accomplish the regenerative engine cycle. The Cowans engine uses a single cylinder shared by the working piston and a displacer, but uses an external regenerator. All of these prior art techniques involve great mechanical complexity it the form of additional valves, pistons, heat exchangers or regenerators, flow passages, mechanical linkages, etc. In the cases of Hirsch, Pattas, and Cowans, the mechanical features of the engines preclude a compression ratio high enough to develop adequate specific power output from a normally aspirated engine. For this reason, the engines of Hirsch, Martinka, and Cowans were designed to be run at an elevated mean pressure, which requires external compressors to compress the inlet air. The Pattas engine, and the two-piston version of the Stockton engine require external blowers to scavenge the exhaust and provide fresh air for combustion.

Analyses of regenerative engine cycles show that the idealized thermodynamic thermal efficiency increases when the compression ratio is decreased, however the cycle mean effective pressure and specific power output descreases as the compression ratio is decreased. Since an engine with low cycle effective pressure must be larger for a given power output, and since heat conduction losses and friction losses increase with engine size, an optimum design must have an intermediate value for compression ratio, i.e. it must be low enough to give acceptable thermodynamic efficiency, but high enough to give low heat conduction and friction losses. For most applications a compression ratio between four and eight appears to be the best compromise. The Hirsch, Pattas, and Cowans engines are incapable of attaining a compression ratio high enough to fall within the optimum range. The reason that these prior art engines cannot attain sufficiently high compression ratios is that non-optimum, near-sinusoidal motions were employed for the displacers (or for second pistons in two-piston type engines) and in all cases the regenerator was in a fixed position relative to the power piston. In engines fo the Hirsch and Pattas types, for instance, the pistons undergo sinusoidal motions with approximately a ninety degree phase difference, and the piston motions cannot overlap since they are separated by a fixed regenerator. In this situation, simple geometric arguments show that the maximum volume ratio cannot be greater than about six, even with a regenerator of zero volume, and if real hardward limitations are taken into account, the resulting compression ratio is far below the optimum value.

The engine disclosed herein uses a basic working unit which consists of a single cylinder and piston and a thin, movable, permeable regenerator which can be swept axially through the working fluid in the space above the piston, and whose motion can overlap the motion of the piston. This is much simpler than any of the prior art engines. The thinness of the regenerator, and the possibility of having the regenerator motions overlap the piston motions makes it possible to have a higher compression ratio than the prior art engines. The regenerator of the disclosed engine is moved by a mechanism such as a cam which can produce the non-sinusoidal regenerator motions which are required to approach the thermodynamically optimum sequence of events. The use of optimum regenerator motions can increase the specific power output of the engine by as much as a factor of five compared to an engine which uses only sinusoidal piston or displacer motions. In contrast to the prior art engines, certain embodiments of the engine herein disclosed can intake air and exhaust spent gases without requiring any assistance from a blower or supercharger. Supercharging may be used with the disclosed engine in order to increase power output, or to provide a lower regenerator cold end temperature, or for other reasons, but it is not necessarily required. The features of the disclosed engine result in a specific power output which is much higher than prior art regenerated internal combustion engines, this in turn permits the use of a smaller engine for a given power output, which results in friction and conduction heat losses which are much lower than in prior art engines.

To summarize, the advantages of the disclosed engine relative to prior art engines include its mechanical simplicity, its high thermal efficiency and power output, its ability to operate without auxiliary superchargers or blowers, and the close similarity of many of the disclosed engine components to those of existing diesel or gasoline engine technology.

SUMMARY OF THE INVENTION

The regenerative internal combustion reciprocating engine and the several variations on its form and operating processes disclosed and claimed herein, are all dependent upon the novel concept of a movable, permeable regenerator located between the piston and cylinder head. This regenerator captures and stores the heat energy normally expelled with the exhaust products of conventional engines, and transfers this energy to the fresh working fluid of subsequent operating cycles of the engine, after compression, but prior to the combustion of the fuel. Rotating regenerators are often applied in Brayton and Rankine cycle engines, and stationary regenerators are an essential part of Stirling engines. Reciprocating regenerators applied to reciprocating internal combustion engines make possible the regenerated, reciprocating, internal combustion engine. Two embodiments of this invention are presented. In the first embodiment the combustion occurs between the regenerator and the piston, and in the second embodiment the combustion occurs between the regenerator and the cylinder head. Either embodiment can be operated in a two or four stroke cycle, and either can be operated with constant volume combustion (i.e. an idealized, regenerated, Otto cycle), near constant pressure combustion (i.e. an idealized, regenerated Diesel cycle), or with combustion occurring while the pressure and volume both vary. A third embodiment is also presented which differs from the two-stroke version of the second embodiment primarily in its lack of moving valves. Finally, three different regenerator designs are presented. The remainder of the engine components are the same, or very similar to current, conventional internal combustion engine hardward. While some differences in the piston, cylinder, valves, ignition source, fuel injector, and seals may be necessary or desirable, compared to conventional internal combustion engines, the primary and most novel feature of this invention is the movable, permeable heat exchanger, which is referred to as the regenerator. It is constructed of such materials, and in such a manner as to allow the working fluid to pass through it and rapidly exchange heat with it. Such motion of the gas through the regenerator is accomplished primarily by causing the regenerator to move in the space between the piston and the cylinder head at the appropriate times in the operating cycle.

The regenerative internal combustion engine operating cycle adds two additional processes to those of conventional diesel or gasoline engines. These are the transfer of heat from the hot working fluid to the regenerator prior to exhaust, and the transfer of heat from the regenerator to the fresh, cool working fluid after compression, but prior to injection and combustion of the fuel.

OBJECTS OF THE INVENTION

An object of this invention is to provide an internal combustion engine in which thermal regeneration is accomplished within the cylinder.

Another object is to provide a thermal regenerator which moves within the cylinder in a prescribed cyclical relationship to the piston and valve motions, so as to extract heat from the expanded combustion gases before they are exhausted, and to convey this heat into the next charge of fresh air after it has been compressed.

Yet another object is to provide an internal combustion engine of extremely high thermal efficiency, approaching the Carnot theoretical cycle efficiency.

Still another object is to provide a regenerated internal combustion engine which is much simpler than any earlier type of regenerated internal combustion engine.

Another object of this invention is to provide a regenerated internal combustion engine which uses components and design technology very similar to those employed in currently manufactured Diesel cycle and Otto cycle engines.

Yet another object is to provide a regenerated internal combustion engine whose configuration and operating cycle permit a high enough compression ratio to give an acceptable specific power output.

An additional object is to provide an internal combustion engine in which the ignition of the fuel is effected by contact with the extremely hot preheated air provided by the regeneration process, or by contact with the hot regenerator surfaces.

Still another object is to provide a thermal regenerator which is not damaged by the high temperature, thermal shock, acceleration and vibration which are normally encountered in an internal combustion engine.

Yet another object is to provide a thermal regenerator with small gas leakage past its periphery.

Another object is to provide a thermal regenerator which offers a low pressure drop to the working fluid passing through it, but yet has a good heat exchange effectiveness.

Still another object is to provide a thermal regenerator which provides rapid local thermal equilibration with the fluid passing through it, but which minimizes axial conduction through the regenerator so as to allow a steep axial temperature profile.

Still another object is to provide an internal combustion engine which provides complete oxidation of hydrocarbons, carbon monoxide, soot and other undesirable materials which might otherwise be discharged into the atmosphere.

Yet another object is to provide an internal combustion engine able to satisfactorily burn fuels having low octane ratings, low cetane ratings, an extended boiling range, low heat content, low flammability, high aromaticity, and soot forming tendency.

Another object is to provide an engine in which the combustion products are cooled by passage through the regenerator before contacting many of the engine components, thus protecting these operating parts from the high temperatures, thermally induced stresses, and temperature gradients which are usually associated with conventional internal combustion engines, and thus improving the life and reliability of the engine.

Another object is to provide a regenerator which is axially thin and has a small internal volume, so as to increase the attainable compression ratio and hence the specific power output.

Yet another object is to provide a regenerated internal combustion engine in which the regenerator motion approaches the thermodynamically optimum motion.

BRIEF DESCRIPTION OF THE DRAWINGS

A better understanding of the invention may be had by reference to the following description, taken in conjunction with the accompanying drawings, in which:

FIGS. 2, *a–j* are a schematic representation of the operational sequence of events in the four stroke cycle operation of the regenerative internal combustion engine of FIG. 1;

DETAILED DESCRIPTION OF THE INVENTION

This invention is a reciprocating regenerative internal combustion engine consisting of a cylinder containing a movable piston and a separately movable permeable regenerator and other operating parts as will be described.

Figure 1:
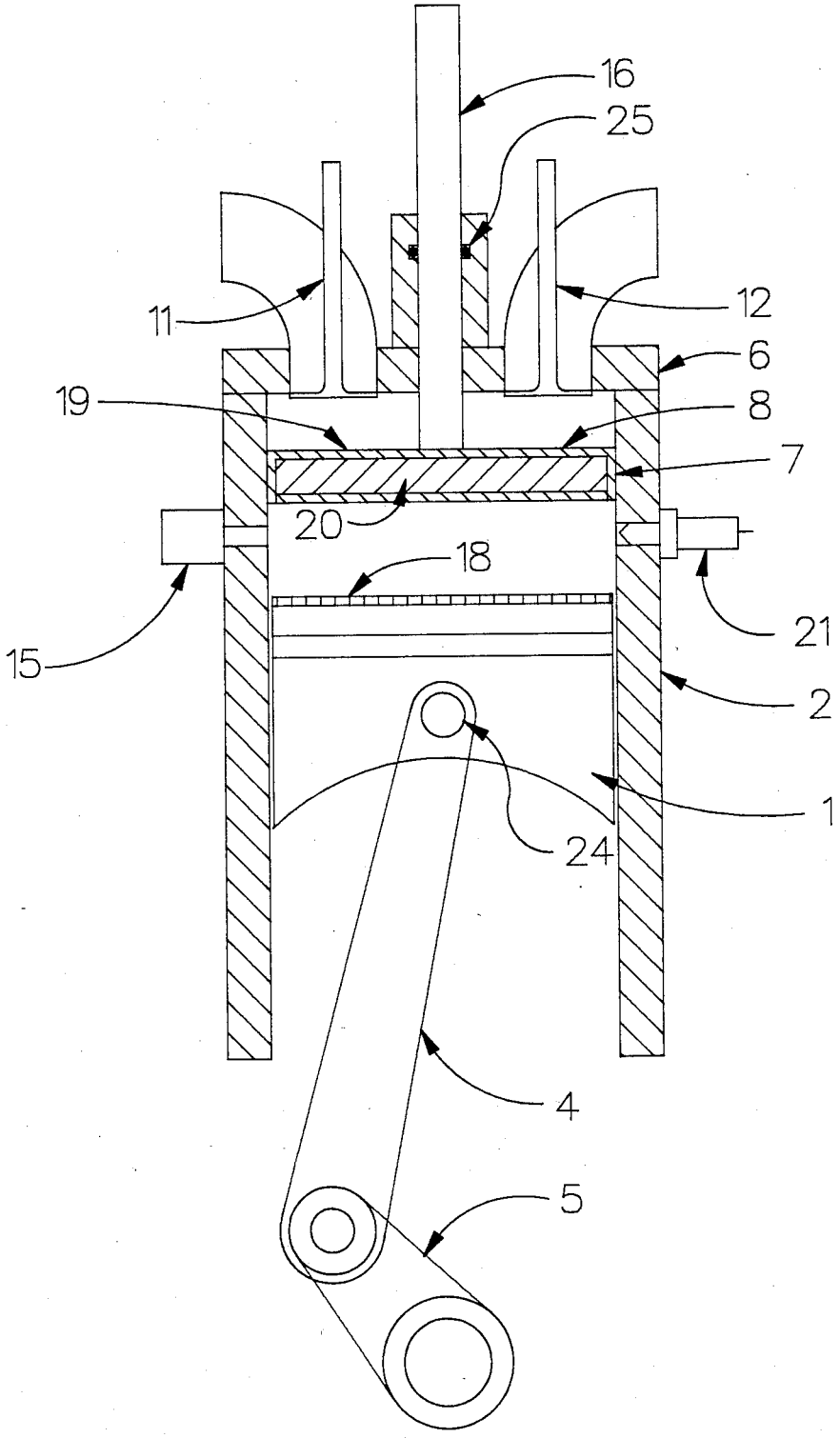
FIG. 1 is a schematic representation of one embodiment of the engine which has the hot combustion space between the regenerator and the piston head.

Referring to FIG. 1, the cylinder (2), is fitted with a cylinder head (6), an intake valve (11) and an exhaust valve (12). A poppet type valve is shown, but a sleeve valve, rotary valve, slide valve, or any other suitable valve type could be used. The cylinder contains a movable piston (1), which is sealed against the cylinder wall by piston rings (23) and which is connected to a crankshaft (5) through any type of suitable mechanical or other linkage for producing reciprocating linear motion, such as the conventional connecting rod (4) and piston pin (24). A high temperature, insulating material (18) is provided on the top of the piston as shown in FIGS. 1 to reduce heat loss and protect the piston.

Located between the piston (1) and the cylinder head (6) is the permeable movable regenerator (7). The regenerator (7) is a heat exchanger which consists of two components, a core (20) and an auxiliary supporting structure (19). This structure (19), serves one or more of the following purposes: it provides support for the core material, containment for the core material, it provides a bearing surface for the cylinder wall, it prevents leakage around the regenerator and it provides a mechanical connection to the regenerator drive rod (16), which causes the regenerator to move. This regenerator drive rod is equipped with an "O-ring" type of seal (25) or other means to prevent leakage of the working fluid from the cylinder. In FIG. 1, the auxiliary supporting structure (19) consists of a perforated metal disk (8) and a cylindrical skirt (9) separating the core (20) from the wall of the cylinder (2). The regenerator core (20) is made of a material having the capability to withstand high temperatures and is so constructed as to have low thermal conductivity in a direction parallel to the cylinder axis. Furthermore, the regenerator (7) is constructed so as to allow the working fluid to pass through it with minimal pressure drop and has a large internal surface area and other features so as to promote and enhance rapid local heat transfer between the working fluid and the regenerator core (20). The regenerator (7) completely fills the cross-section of the cylinder (2), and allows no working fluid to move between the volume above it and the volume below it, except by flowing through the heat transfer material contained in the regenerator core (20). It is not necessary for the regenerator (7) to seal against the cylinder wall as tightly as the piston (1) does, because the pressure difference across it is always small, but gas leakage around the regenerator should be minimized. This can be done by providing a close circumferential fit, or equipping the regenerator with a labyrinth seal or with a piston ring or other devices to minimize gas leakage around the regenerator. The proper motion of the regenerator can be accomplished by a variety of mechanical, hydraulic, pneumatic or electrical means, or combinations of these, such as the means commonly employed to operate conventional reciprocating engine poppet valves. The engine is also equipped with a conventional fuel injector (15) and means for injecting the appropriate quantity of fuel into the space between the regenerator (7) and the piston (1) at the desired time during the operating cycle. The engine shown in FIG. 1 is also equipped with a spark plug (21) and means for providing a properly timed spark to ignite the fuel. In addition to the valve locations shown in FIG. 1 which depicts overhead valves, other valve locations are possible. For example, conventional "L-head" and "T-head" cylinder head and valve designs can be employed, or valves can be located in the upper portion of the cylinder wall. The only constraint on valve location is that the intake and exhaust of working fluid must occur in the volume above the regenerator.

Figure 3:
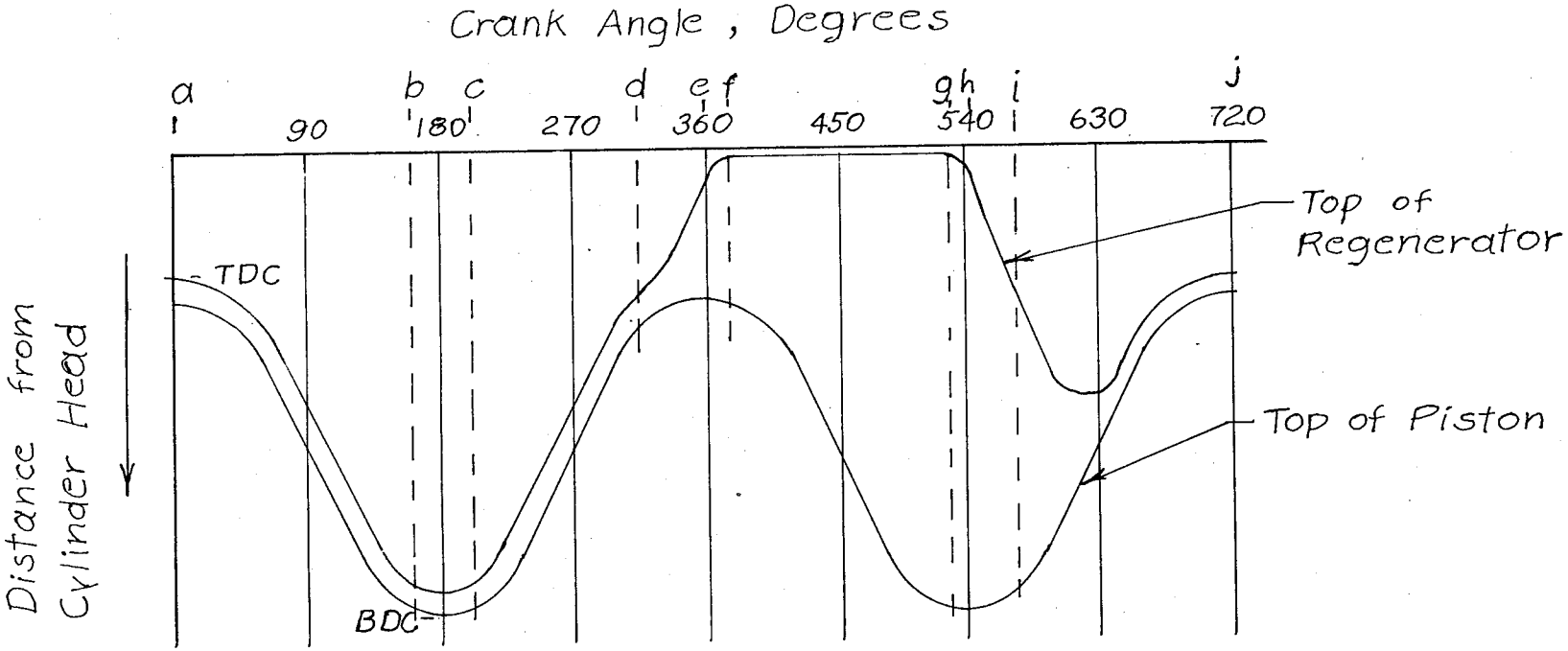
FIG. 3 is a plot of regenerator and piston positions, relative to the cylinder head, during the four stroke cycle operation of the engine of FIG. 1.
Figure 4A:
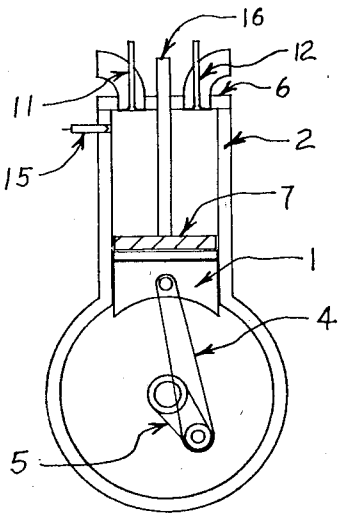
FIGS. 4, *a–g* are a schematic representation of the operational sequence of events in the two stroke cycle operation of the engine of figure 1.
Figure 4B:
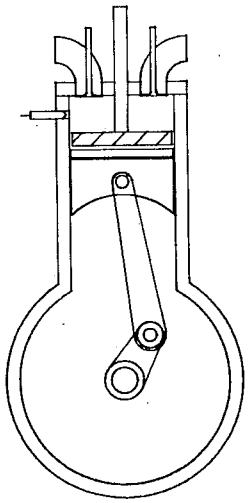
Figure 4C:
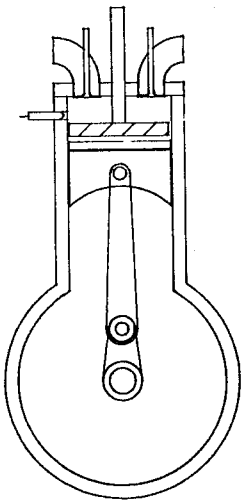
Figure 4D:
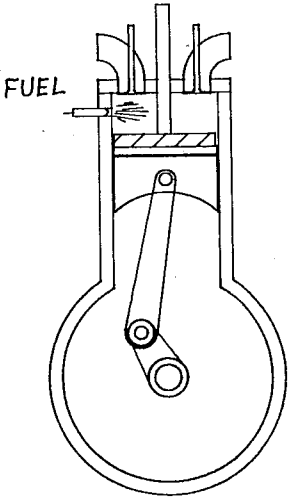
Figure 4E:
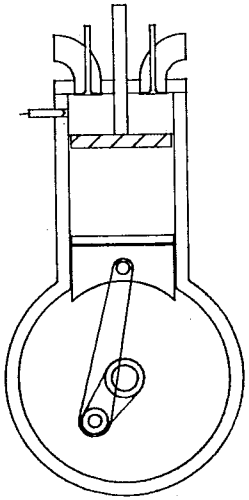
Figure 4F:
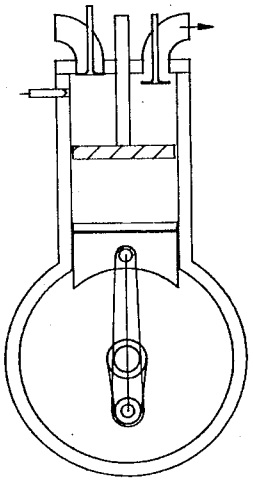
Figure 4G:
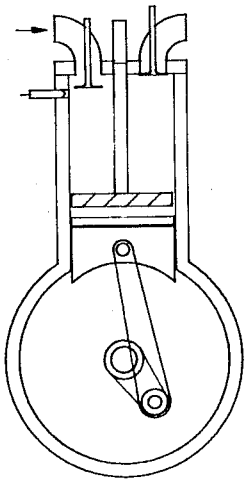

Now referring to FIGS. 2 and 3, the four stroke cycle operation of the engine is depicted. FIG. 2 shows the various piston, regenerator and valve positions at various times or crank angles during the cycle. FIG. 3 is a plot of the positions of the piston and regenerator throughout one operating cycle of two revolutions or four strokes or 720 degrees of arc. The positions depicted in FIG. 2 by the letters a through j are correspondingly marked in FIG. 3 and are referred to in the following description of the operating cycle. The first step (a) consists of opening the intake valve (11) while the piston is near the top of its stroke, with the exhaust valve (12) closed, and with the regenerator (7) positioned as closely as possible to the top of the piston (1). "Top" of "up" here means a location near or toward the cylinder head; the engine can be operated in any orientation. The piston (1) and regenerator (7) are now moved to the bottom of the stroke (a to b), moving together. The downward motion of the piston draws fresh air into the cylinder (2) through the intake valve (11). The intake valve (11) is now closed (*c*), and the piston (1) and regenerator (7) are moved upward (*c* to *d*) together to the top of the stroke, compressing the air into the volume at the top of the cylinder. As the piston approaches the top of the stroke, the regenerator (7) is separated from the piston (1) and moved to the top of the cylinder (*d* to *e*). As the regenerator (7) moves upward, the compressed air enters its cooler upper surface and is forced to pass through the regenerator core, and in so doing is heated by the hot regenerator.

Fuel is now injected from the fuel injector (15) into the space between the top of the piston (1) and the bottom of the regenerator (7) (*f*), and is ignited by the high temperature of the air, by exposure to the hot bottom surface of the regenerator, or by the spark plug (21) (not shown in FIG. 2). The hot, high pressure working fluid pushes the piston (1) to the bottom of its stroke, while the regenerator (7) is caused to remain at rest near the top of the cylinder (*f* to *g*). During the downward motion of the piston (1) the hot working fluid expands and converts part of the heat contained in the working fluid into work. As the expansion stroke nears completion (*g*), the regenerator (7) is moved from its position near the top of the cylinder down toward the piston (1), passing through the expanded working fluid, and absorbing the unutilized high temperature heat which it contains (*h*). As the working fluid is cooled by its passage through the regenerator (7) the pressure in the cylinder falls. As the regenerator (7) is moved downward the exhaust valve (12) is opened (*i*). The piston (1) and the regenerator (7) meet and then move upward together, expelling the spent, cooled, working fluid through the exhaust valve (12) (*i* to *j*). The exhaust valve (12) now closes, the intake valve (11) opens, and the next cycle begins (a).

Figure 5:
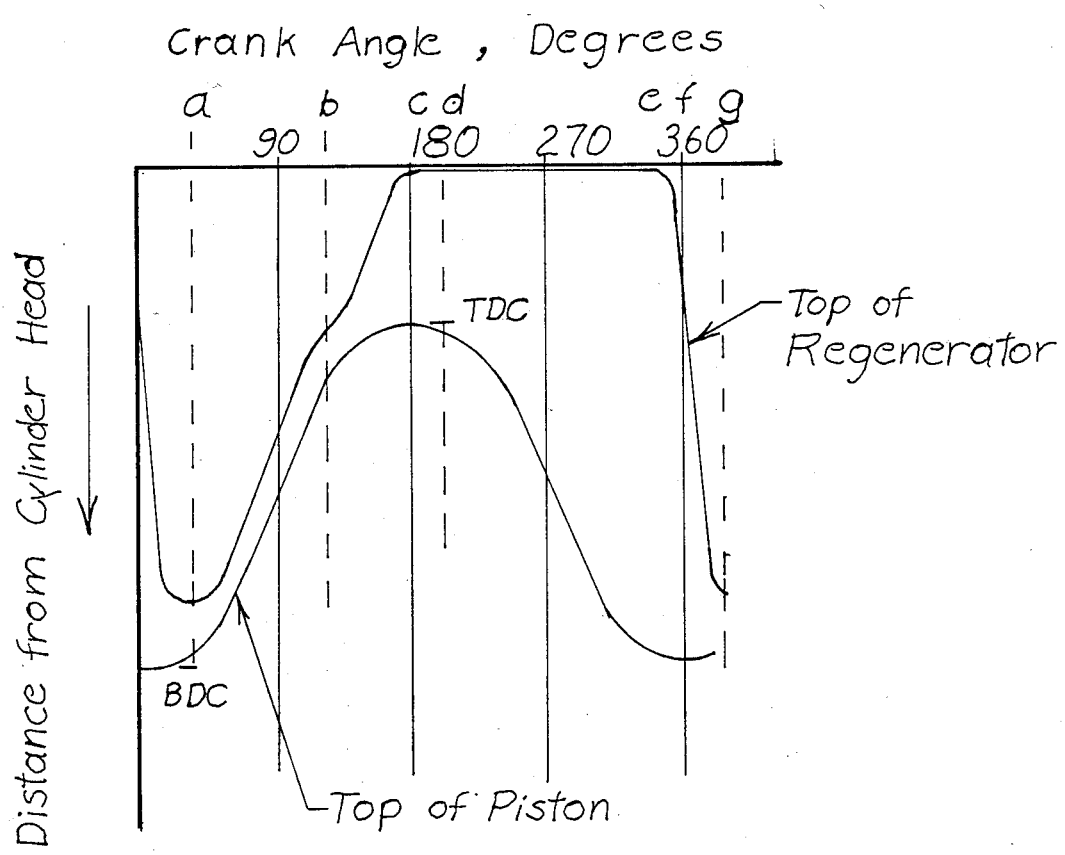
FIG. 5 is a plot of regenerator and piston positions, relative to the cylinder head, during the two stroke cycle operation of the engine of FIG. 1.

Now referring to FIGS. 4 and 5, the two stroke cycle operation of the engine is illustrated. The hardware is the same as in FIG. 1, but the timing of the valve and regenerator motions is different. FIG. 4 shows the various piston, regenerator and valve positions at various times or crank angles during the cycle. FIG. 5 is a plot of the positions of the piston and regenerator throughout one operating cycle of one revolution or two strokes or 360 degrees of arc. The positions depicted in FIG. 4 by the letters a through g are correspondingly marked in FIG. 5 and are referred to in the following description of the operating cycle. The two stroke cycle operation description begins with the compression stroke (a to b). The piston (1) and regenerator (7) are positioned closely together and are at or near the bottom dead center position. Both the intake and exhaust valves (11 and 12) are closed. The piston (1) and regenerator (7) are moved upward together, compressing the air into the top part of the cylinder. At or near the end of the compression stroke, the regenerator (7) separates from the piston (1) and moves upward through the compressed air to the top of the cylinder (2), heating the air to a high temperature (*b* to *c*). The injector (15) then injects fuel into the regeneratively heated air between the piston (1) and regenerator (7) (*d*). The fuel is ignited by the high temperature of the air, by the hot bottom surface of the regenerator (7), or by the sparkplug (21) (not shown in FIG. 4) and by burning, adds heat to the working fluid. The fuel could also be injected and burned during the expansion stroke.

The hot, high pressure working fluid pushes the piston (1) downward, and during its expansion converts some of its heat into work (*d* to *e*). During most of the expansion stroke, the regenerator (7) stays near the top of the cylinder. At some time during or after the expansion stroke, the regenerator (7) starts to move downward, and shortly thereafter, the exhaust valve (12) opens (*f*). Since most of the working fluid is still at a high temperature, the pressure in the cylinder (2) is higher than atmospheric, and the working fluid flows through the regenerator (7) and out the exhaust valve (12). In passing through the regenerator (7) the working fluid gives up its unutilized high temperature heat. As soon as the pressure in the cylinder has fallen to approximately atmospheric, the exhaust valve (12) closes, and the intake valve (11) opens (*g*). The regenerator (7), continues to move rapidly downward toward the piston (1). As the regenerator (7) moves through the hot residual working fluid in the cylinder (2), it extracts heat from it, cooling it and causing it to contract, and reducing its pressure. This contraction and reduction of pressure draws fresh air in through the intake valve (11). When the regenerator (7) closely approaches the piston (1), and the pressure approaches atmospheric, the intake valve (11) closes, the the next cycle begins (*a*). A blower may be employed to assist in forcing the fresh charge of air into the cylinder (2), and if this is done, the exhaust valve (12) is allowed to remain open for a short period of time after the intake valve (11) opens to permit more complete scavenging or exhausting of the combustion gases.

Figure 6:
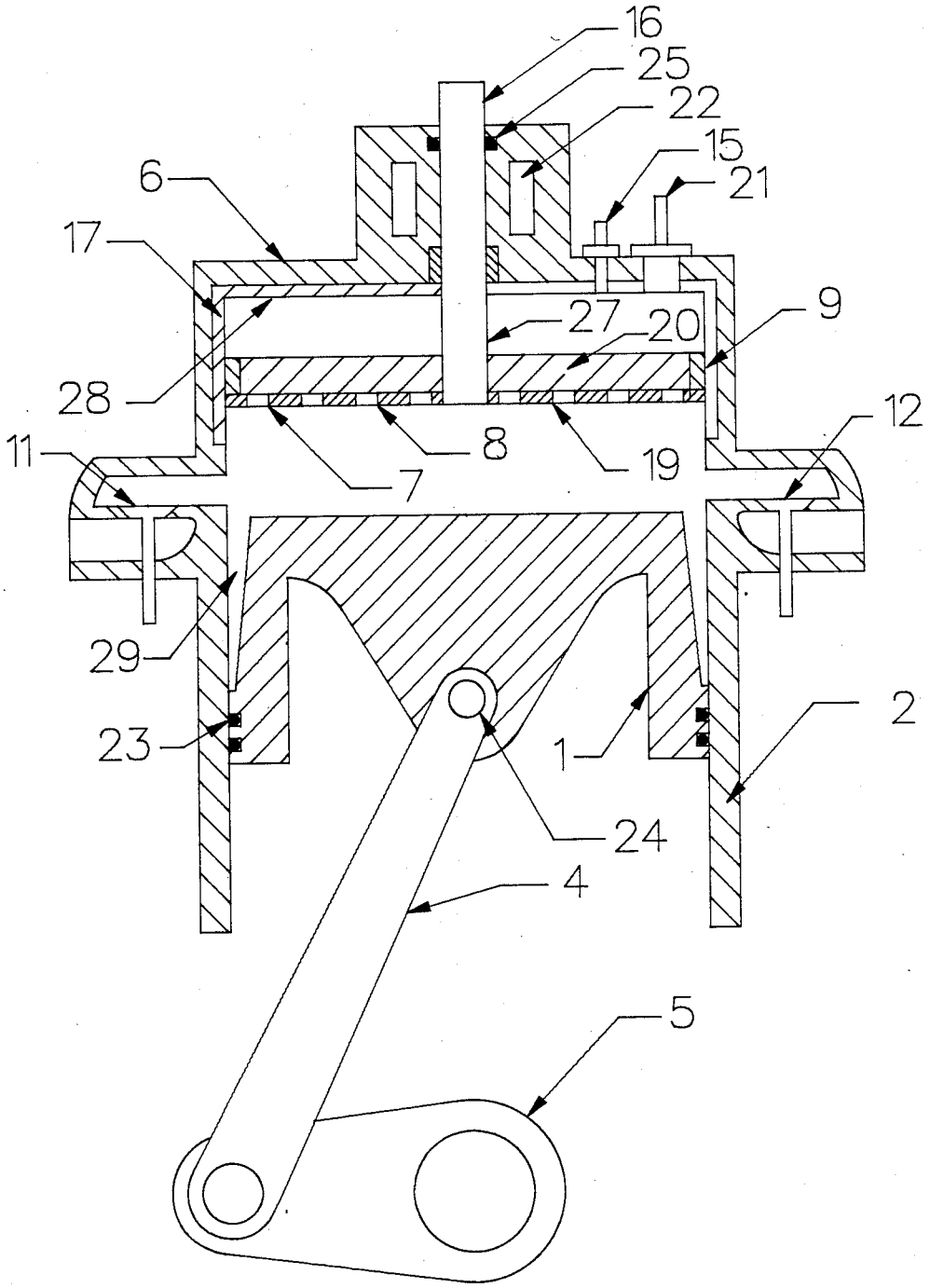
FIG. 6 is a schematic representation of another embodiment of the engine, which has the valves located sufficiently far down in the cylinder wall so as to admit fresh air to, and expel exhaust from the volume below the regenerator, and has the hot combustion space located between the regenerator and the cylinder head.

Now referring to FIG. 6, another embodiment of this regenerative internal combustion concept is presented. The primary difference between the design of FIG. 1 and the design of FIG. 6 is that the high temperature volume, where the combustion occurs, is located between the regenerator (7) and the cylinder head (6), rather than between the regenerator (7) and piston (1), and the fresh air is admitted to, and the exhaust expelled from, the volume between the regenerator (7) and the piston (1). This design, referred to as a cold piston engine design, reduces heat loads on the piston assembly but requires unconventional valve locations and less desirable flow passages for the intake of fresh air and the expulsion of exhaust gases. The embodiment shown in FIG. 6 contains all the same major components as those of FIG. 1. It can also operate in either the two or four stroke manner. The piston (1) moves in the cylinder (2) and transfers work to and from the crankshaft (5)

via means such as the connecting rod (4) and piston pin (24) shown in FIG. 6. A regenerator (7) lies between the piston (1) and cylinder head (6). Since the cylinder head (6) is now exposed to the hot combustion gases for relatively long periods of time it is provided with a high temperature insulative barrier or coating (18) on the inner surface of the cylinder head(6). The upper, interior portion of the cylinder (2) is also provided with a similar, high temperature, insulative cylinder liner (17). The intake valve (11) and exhaust valve (12) are located so as to allow the working fluid to enter and leave the cylinder (2) only from the volume between the piston(1) and regenerator (7). This is accomplished by valves of the type, and at the location, shown in FIG. 6, or by other means or valve locations, including valves located in or on the piston (1). The regenerator (7) is of similar construction as previously described and depicted in FIG. 1, except that the upper surface is now the hot surface and the lower surface is relatively cool. The regenerator presented in FIG. 6 has an auxiliary supporting structure (19) consisting of a perforated round metal disk (8) connected to a cylindrical skirt(9). The skirt (9) has a close circumferential fit with the cylinder wall. The proper motion of the regenerator (7) is accomplished by any of a variety or combination of mechanical, hydraulic, pneumatic or electrical means acting on the regenerator drive rod (16) illustrated in FIG. 6. The regenerator drive rod (16) is protected from the high temperature it will be exposed to, by the insulative barrier (27) and water jacket (22) shown in FIG. 6. The regenerator drive rod (16) is also equipped with a dynamic sealing means, such as the "O" ring type seal (25) shown in FIG. 6.

Means are provided for the passage of the working fluid between the intake and exhaust valves (11) and (12), and the volume between the regenerator (7) and the piston (1), during the intake and exhaust strokes. Such means are provided through the use of a piston with a sufficiently large annular clearance (29) between itself and the cylinder, as shown in FIG. 6. The piston (1) has its piston rings (23) located sufficiently far from the piston head to prevent the interference of the sealing mechanism with the passage of the working fluid from the valves to the volume above the piston head. Pistons having slots or other types of flow passages, or valves located higher on the cylinder wall or in the piston can also be employed. Also, the low temperature of the piston permits the use of other sealing means, or materials, such as teflon "O-rings". A means for injecting fuel into the upper portion of the cylinder, such as a conventional fuel injector (15) is provided. A means is provided for igniting the fuel such as a glowplug or spark plug (21).

Figures 7A, 7B, 7C, 7D, 7E, 7F, 7G, 7H, 7I, 7J:
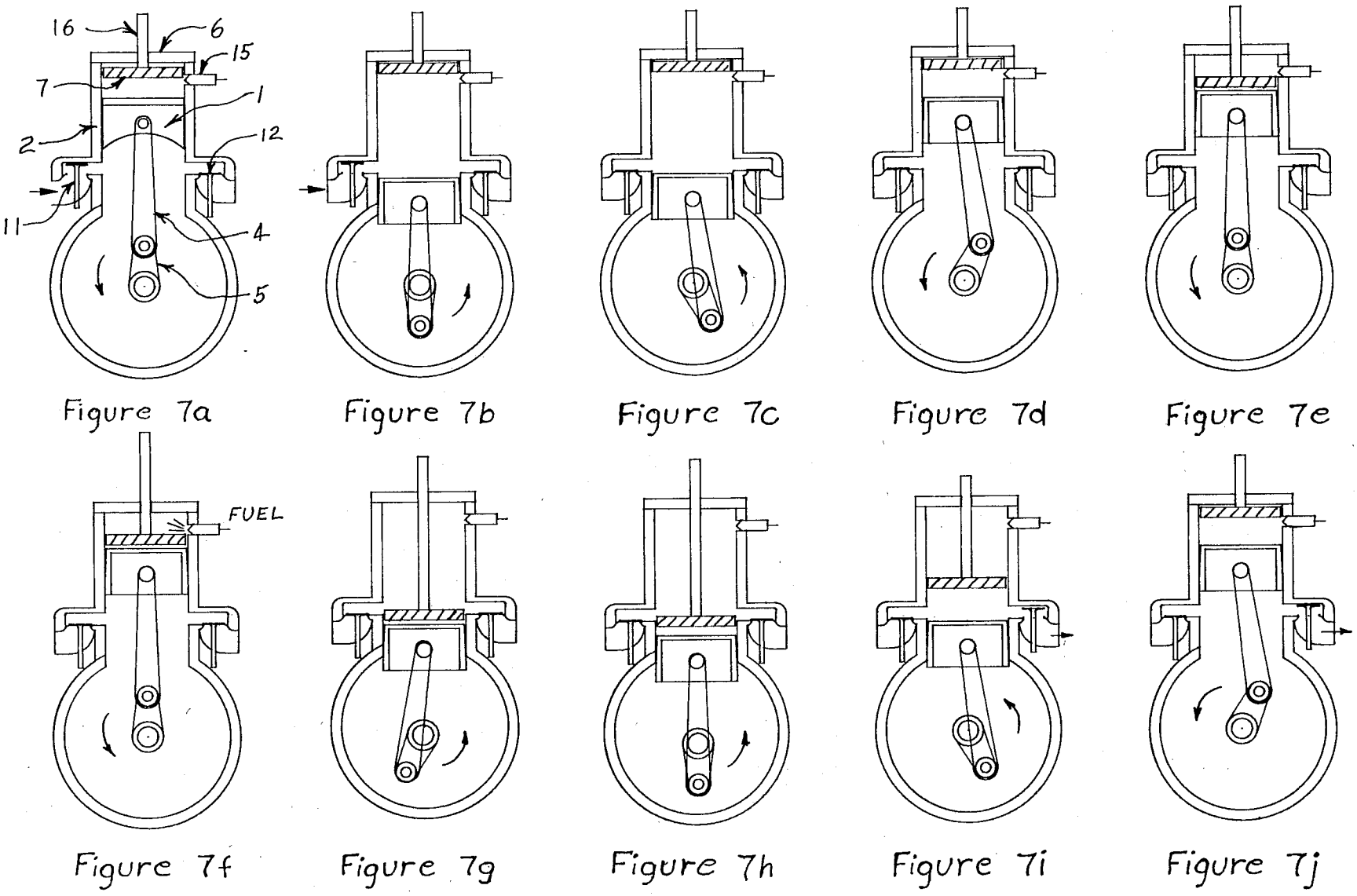
FIGS. 7, *a–j* are a schematic representation of the operational sequence of events in the four stroke cycle operation of the regenerative internal combustion engine of FIG. 6.
Figure 8:
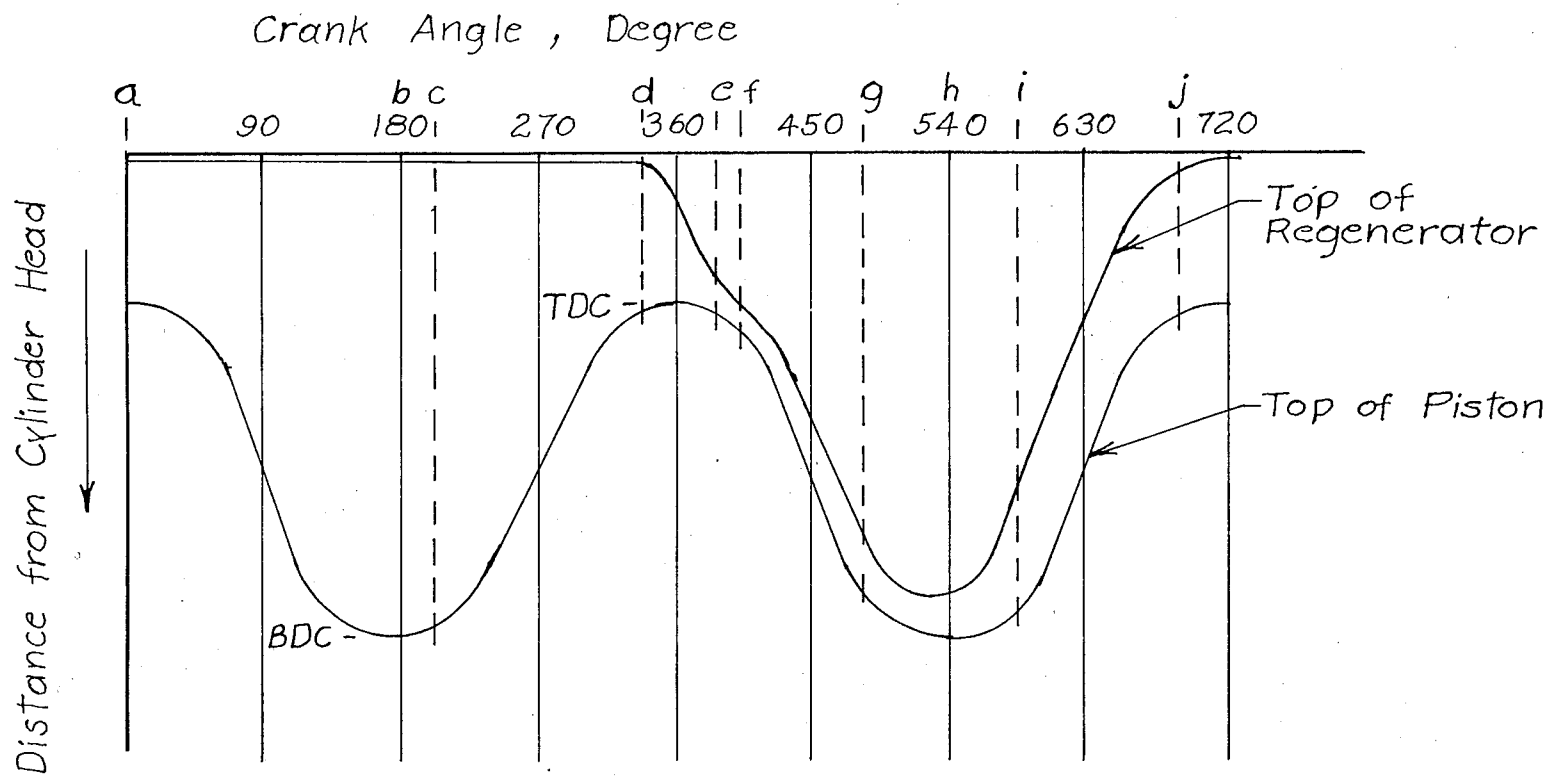
FIG. 8 is a plot of the regenerator and piston positions, relative to the cylinder head, during the four stroke cycle operation of the engine of FIG. 6.

Referring now to FIGS. 7 and 8 the sequence of events which constitute the four stroke cycle operation of the engine of FIG. 6 are described. FIG. 7 shows the various piston, regenerator and valve positions. FIG. 8 is the corresponding plot of the regenerator and piston positions during the operating cycle of two revolutions, four strokes or 720 degrees of arc. The positions are shown by letters a to j both in FIG. 7 and FIG. 8 and in the following description. The intake stroke starts with the regenerator (7) positioned as close as possible to the cylinder head (6), with the piston (1) at top dead center, with the exhaust valve (12) closed and with the intake valve (11) open (*a*). The intake stroke is accomplished by moving the piston (1) to a position near bottom dead center while the regenerator (7) remains in place (*a* to *b*). The downstroke of the piston (1) draws fresh air through the intake valve (11), and into the volume between the piston and the regenerator (7). Next the intake valve (11) is closed (*c*), and the piston (1) is moved upward compressing the air (*c* to *d*). When the piston (1) is at or near its top dead center position, the regenerator (7) is moved downward (*d* to *e*) to a position very close to the piston (1). The compressed air enters the lower, cooler surface of the regenerator (7), is heated as it progresses through the regenerator (7), and emerges from the hot upper surface of the regenerator (7) at a much higher temperature. Fuel is then injected into the heated air between the regenerator (7) and cylinder head (6), and is burned to add heat to the working fluid (*f*). The high pressure heated working fluid pushes the piston (1) to its bottom dead center position, while the regenerator (7) is moved to follow the piston as close as is possible (*f* to *g*). As the piston (1) nears the bottom dead center position (*g*), the motion of the regenerator (7) is reversed, and it is now moved upward (*h* to *i*) through the expanded combustion products so as to extract the unutilized high temperature heat remaining in the gas. The exhaust stroke (*i* to *j*)is performed by opening the exhaust valve (12), at any time after the regenerator (7) has passed by and is above the exhaust port, and moving the piston (1) to its top dead center position. It is also possible to start the upward motion of the regenerator prior to its passage of the valves or valve ports during the power stroke. The rising piston (1) forces the spent, cooled combustion products out through the exhaust valve (12). The exhaust valve (12) is now closed, the intake valve (11) is opened, and the next cycle of operation begins (*a*).

The two-stroke cycle operation of the engine of FIG. 6 is very similar to the four-stroke cycle just described, but with the following differences. The intake and exhaust processes occur nearly simultaneously, near or after the completion of the power stroke. As the piston (1) approaches its bottom dead center position, the regenerator (7) starts to rise toward the cylinder head. The exhaust valve (12) opens, discharging the pressurized combustion products, which travel from the volume between the regenerator (7) and the cylinder head (8) through the regenerator (7), where they give up their high temperature heat, and then out through the exhaust valve (12). As soon as the pressure has dropped approximately to atmospheric pressure, the exhaust valve (12) is closed, and the intake valve (11) is opened. As the regenerator (7) is rapidly moved toward the cylinder head it cools the combustion products through which it passes, causing them to contract and causing fresh air to be drawn to through the intake valve. A blower may be employed to assist in forcing fresh air into the cylinder. If a blower is used, it may be desirable to allow the exhaust valve (12) to remain open for a short period of time after the intake valve (11) has opened in order to permit more thorough scavenging of the exhaust gases.

Figure 9:
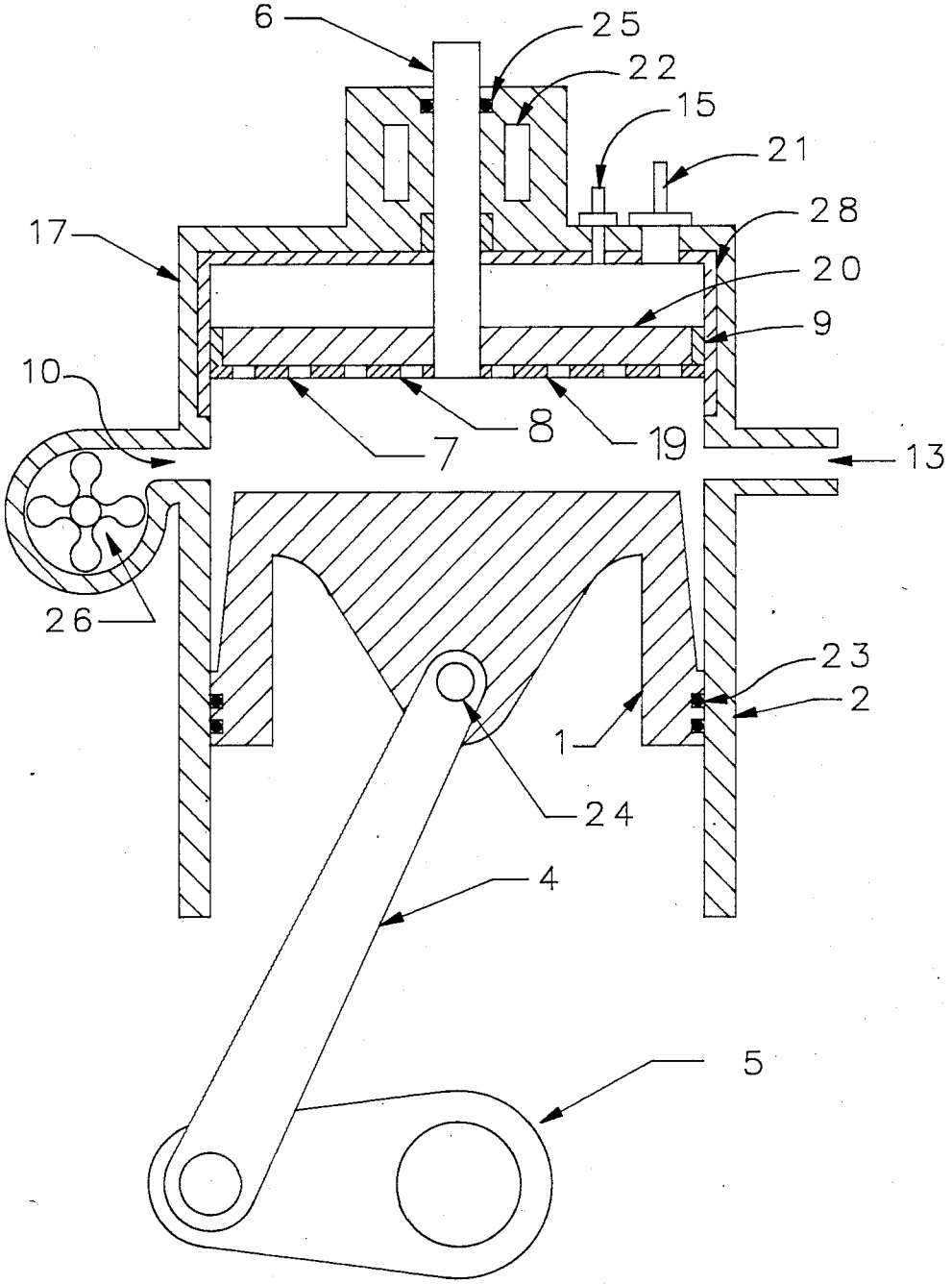
FIG. 9 is a schematic representation of another embodiment of the engine, which admits fresh air and exhausts spent combustion products through cylinder wall ports which are alternately covered and uncovered by the motion of the piston, with the hot combustion space located between the regenerator and the cylinder head.
Figure 10A:
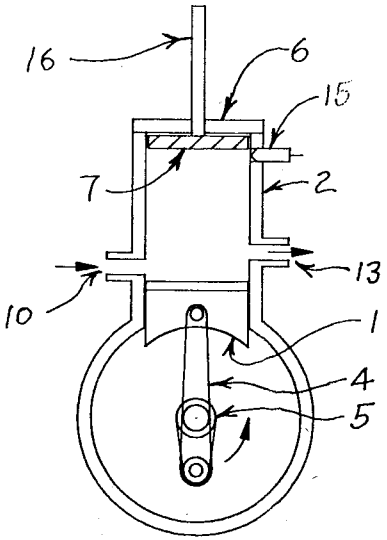
FIGS. 10, *a–h* are a schematic representation of the operational sequence of events in the two stroke operation of the regenerative internal combustion engine of FIG. 9.
Figure 10B:
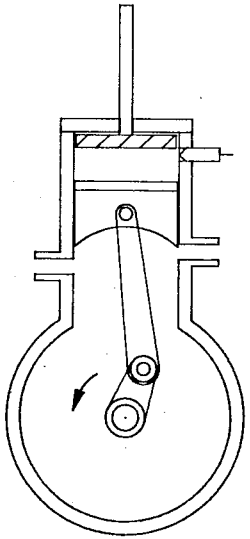
Figure 10C:
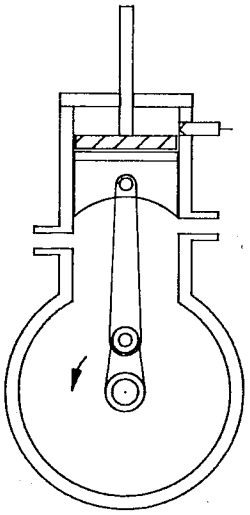
Figure 10D:
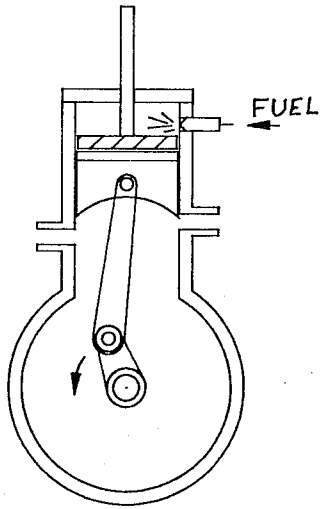
Figure 10E:
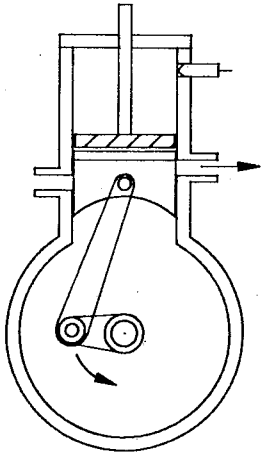
Figure 10F:
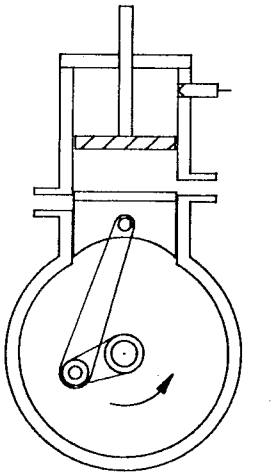
Figure 10G:
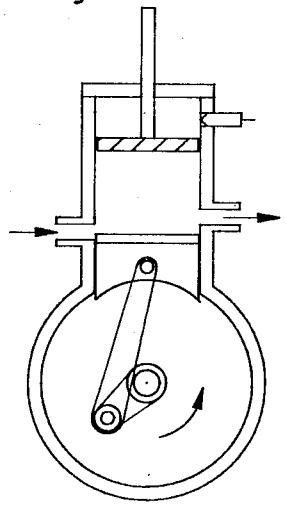
Figure 10H:
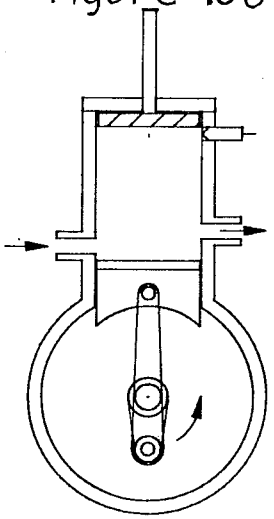

Referring now to FIG. 9, a two-stroke ported engine with a movable permeable regenerator is shown. The primary difference between this engine and that previously described and shown in FIG. 6, is the lack of valves and the use of a blower (26) for supplying pressurized working fluid to the engine. The working fluid flows into, and the exhaust gas flows out of the volume between the regenerator (7) and the piston (1) through an intake port (10) and an exhaust port (13) in the cylinder wall, respectively. These ports are uncovered by the motion of the piston (1) near the bottom of its stroke. This eliminates the need for moving valves. The fuel is injected into, and the combustion taken place in the volume between the regenerator (7) and the cylinder head (6). The cylinder (2); cylinder head (6); connecting rod (4); crankshaft (5); regenerator (7) which is composed of a core (20) and an auxiliary supporting structure (19) consisting of a perforated disc (8) and a circumferential skirt(9); the fuel injector (15);regenerator driving rod (16); regenerator driving rod seal (25); water jacket (22); regenerator drive rod liner (27); high temperature cylinder liner (17); spark plug (21); piston rings (22); piston pin (24); and cylinder head liner (28) shown in FIG. 9 are the same as those shown in FIG. 6. The piston (1) is of a more conventional design, similar to those commonly employed in two-stroke ported engines.

Figure 11:
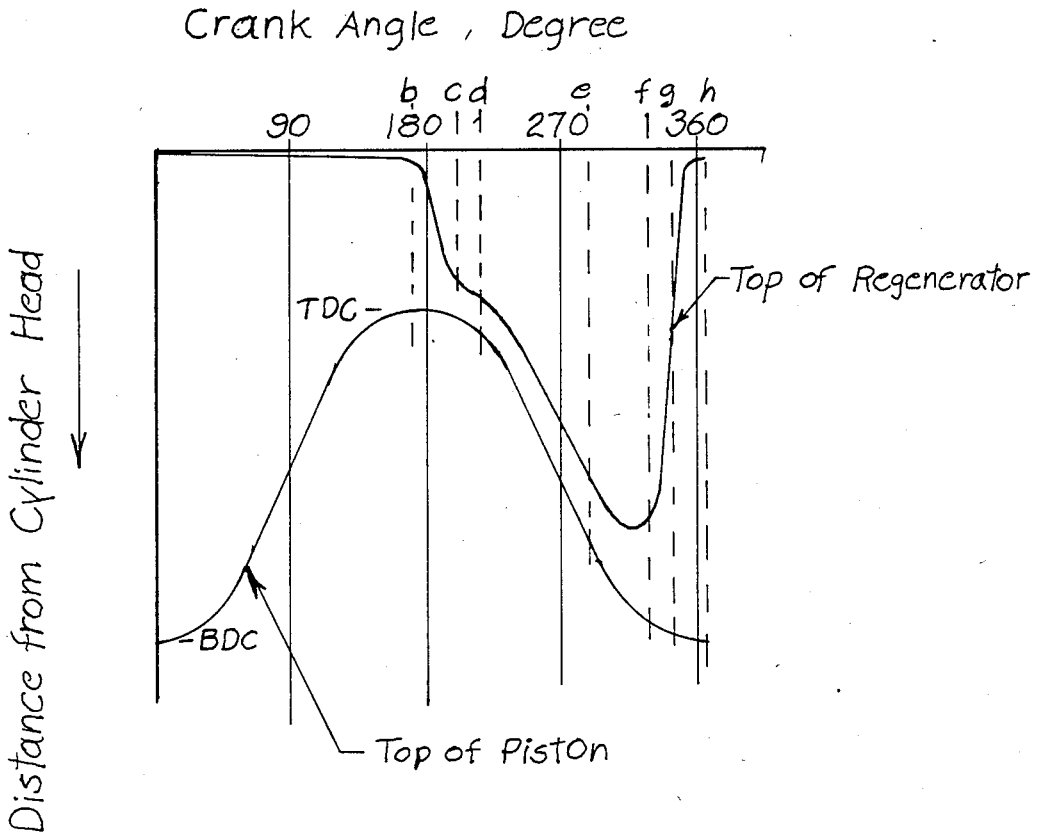
FIG. 11 is a plot of the positions of the regenerator and piston, relative to the cylinder head, for the two stroke cycle operation of the engine of FIG. 9.

Referring now to FIGS. 10 and 11, the steps in this cycle are depicted in FIG. 10, and the corresponding piston and regenerator positions are presented in FIG. 11. The engine component positions shown in FIG. 10 (*a* through *h*) are correspondingly marked in FIG. 11 and described below. The cycle commences when the piston (1) is at or near bottom dead center, with pressurized air flowing in through the intake port (10) and sweeping exhaust gas out of the cylinder through the exhaust port (13) (*a*). This pressurized air is provided by the blower (26). The regenerator (7) is at or near and approaching the cylinder head (6) during this intake and exhaust portion of the cycle. The piston (1) is now moved upward, so as to seal off the intake port (10) prior to the exhaust port (13), and then to compress the working fluid. When the piston (1) is at or near to the top of its stroke (*b*), the regenerator (7) is moved downward through the compressed working fluid to a position near the piston (*b* to *c*), so as to transfer stored high temperature heat from the regenerator (7) into the compressed working fluid. Fuel is now injected, by a conventional fuel injector (15) into the compressed, regeneratively heated working fluid in the volume between the regenerator (7) and the cylinder head (6) (*d*). The injected fuel is ignited either by contact with the hot preheated air and regenerator surfaces or by a glow plug or spark igniter (21), not shown in FIG. 10 or other means. The combustion of the fuel adds heat to the working fluid, either while the piston (1) is near the top dead center position, or during a portion of the expansion stroke. The hot, high presure working fluid pushes the piston (1) downward while simultaneously the regenerator (7) is moved downward, following piston (1) closely (*d* to *e*). As the working fluid expands, work is extracted from it. Before the piston (1) uncovers the exhaust port (13), the regenerator (7) is separated from the piston (1) and remains above the exhaust port (13). The gas which passes through the regenerator (7) at this time is cooled, transferring its heat to the regenerator core. As the piston (1) continues to move downward (*f*) it uncovers the exhaust port (13) in the wall of the cylinder (2). This allows some of the working fluid to flow out until the pressure in the cylinder falls to atmospheric pressure. The working fluid which passes through the regenerator at this time transfers its heat to the regenerator core, and so is cooled. The piston (1) continues to move downward, uncovering the intake port (11) (*g*), which allows the fresh air to flow into the volume between the piston (1) and the regenerator (7) and forcing out the exhaust. As the intake and exhaust processes take place, the regenerator (7) moves upward toward the cylinder head (6), passing through the hot working fluid and extracting the remainder of the unutilized high temperature heat from it (*h*), and the cycle is ready to start again (*a*).

It should be realized that the descriptions of the cycles shown in FIGS. 2 and 3, 4 and 5, 7 and 8, and 10 and 11, are somewhat idealized in order to clearly convey the essential steps in the process. There is some deviation and overlap possible in the timing of certain of the steps, such as the injection of the fuel, the opening of the exhaust valve, and in the length of the regenerator stroke near the end of the power stroke. Since the gas temperature in this engine is mostly controlled by the action of the regenerator, fuel can be injected and burned efficiently at any time during the power stroke. If the fuel is injected and burned while the piston is near the top dead center position, i.e. approximating constant volume combustion, then the ideal engine cycle would be that of a regenerated Otto cycle. If the fuel is injected and burned during the expansion stroke, i.e. approximating constant pressure combustion, then the ideal engine cycle would be that of a regenerated Diesel cycle. Early injection provides more time for the combustion process to go to completion, but creates a somewhat higher peak temperature. The amount of fuel injected and burned is always far less than the maximum amount which could be burned by the oxygen which is present. Hence with the appreciable excess of highly preheated air, the combustion of the fuel is rapid and complete, leaving no appreciable amounts of unburned hydrocarbons, carbon monoxide or soot.

A reciprocating regenerative internal combustion engine will generally consist of several working units, generally referred to as cylinders. Each working unit or cylinder consists of piston and regenerator assemblies of a type described herein. These cylinders in a multi-cylinder engine may be arranged in any configuration or orientation for conveying power to a shaft or shafts in the same manner as conventional, multi-cylinder, reciprocating internal combustion engines.

The different coatings and protective barriers noted in the embodiments of regenerative, reciprocating internal combustion engines presented herein, are intended to provide the engine components with thermal and oxidation protection from the high temperature working fluid. These coatings or barriers consist of ceramic or other materials which can withstand high temperatures. These protective coatings or barriers can be omitted if the engine is operated at low temperature (e.g. by limiting the quantity of fuel injected) or when additional cooling means are provided, e.g. by a water jacket surrounding the engine.

The working fluid of the embodiments of the engine described herein consists of air and air mixed with the products of combustion of air and fuel. Other gases or gas mixtures capable of supporting combustion can also be utilized. The fuel may be any gas, liquid, or finely divided solid capable of exothermic reaction with the air or other working fluid.

All of the engine embodiments presented herein utilize a spark plug for ignition of the fuel. A glow plug, hot wire, or other means for igniting the fuel can be employed instead of the spark plug. For some engines, ignition means are only necessary for starting a cold engine.

A blower (26) is depicted in FIG. 9 and mentioned in the description of the two-stroke operating cycle of the embodiment of this engine depicted in FIG. 9. Other, conventional means of providing pressurized working fluid to the engine may also be employed, such as turbochargers or crankcase compression.

The movable, permeable regenerator located within the cylinder, and the process of thermal regeneration within the cylinder of a reciprocating internal combustion engine, which are described herein, can be advantageously applied to a wide variety of engine configurations. Three embodiments of such engines and their associated operating processes have been presented herein in FIGS. 1, 6, and 9. Each has advantages and disadvantages which make it appropriate for special applications. The preferred embodiment of FIG. 1 has the advantage that all of the working fluid can be swept through by the regenerator, which (as will be explained later) means that high torque, efficiency, and power output can be attained. The disadvantage of this design is that the piston must be adjacent to the high temperature region of the cylinder. Means must be provided to protect the piston from this hot environment, such as the high temperature piston liner (18) shown in FIG. 1, increased cooling of the piston, or both. While "L"-head, "T"-head and other engine configurations can be advantageously applied to reduce the crowding of valve and regenerator motion mechanisms in the cylinder head, their use requires passages that cannot be swept by the regenerator. As will be explained later, this reduces engine performance. The embodiment of FIG. 6 has an especially desirable combustion environment, and can be constructed to give very low heat losses, but cannot give as high a specific power output as the engine of FIG. 1 because of the volume of the gas flow passage in or around the piston which cannot be swept by the regenerator. The engine of FIG. 9 offers the advantage of mechanical simplicity, because it does not require valves or valve actuation mechanisms.

Figure 12:
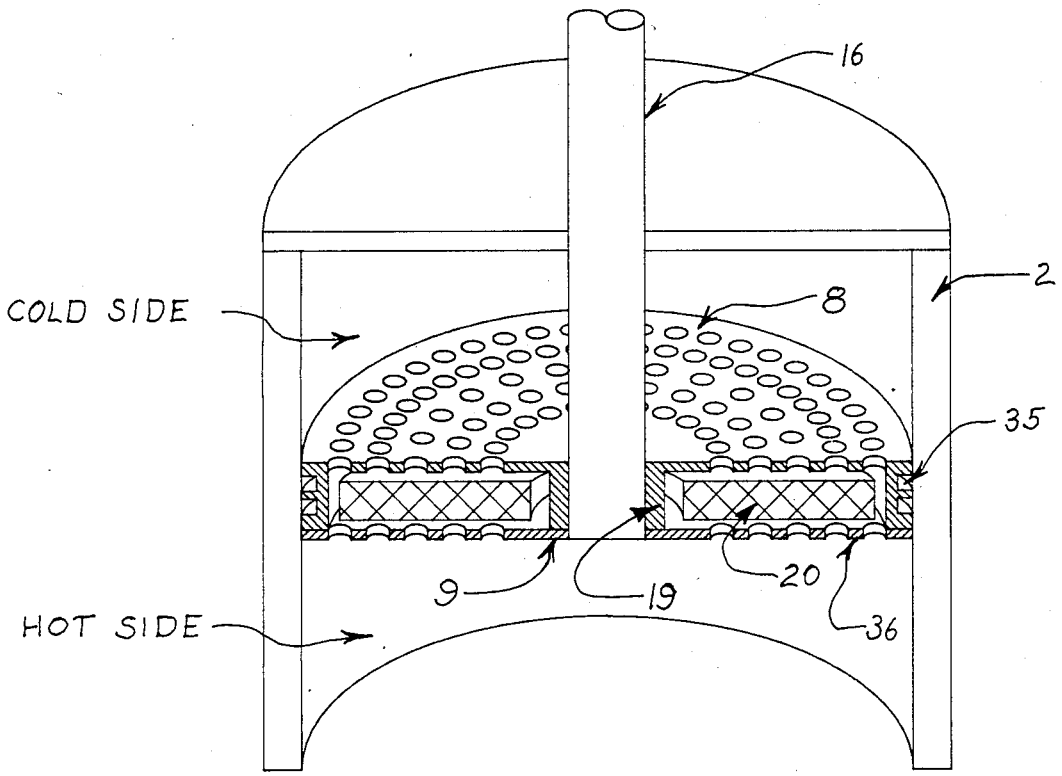
FIG. 12 is a schematic representation of a regenerator having a ceramic felt core, an auxiliary supporting structure, and a labyrinth seal.
Figure 13:
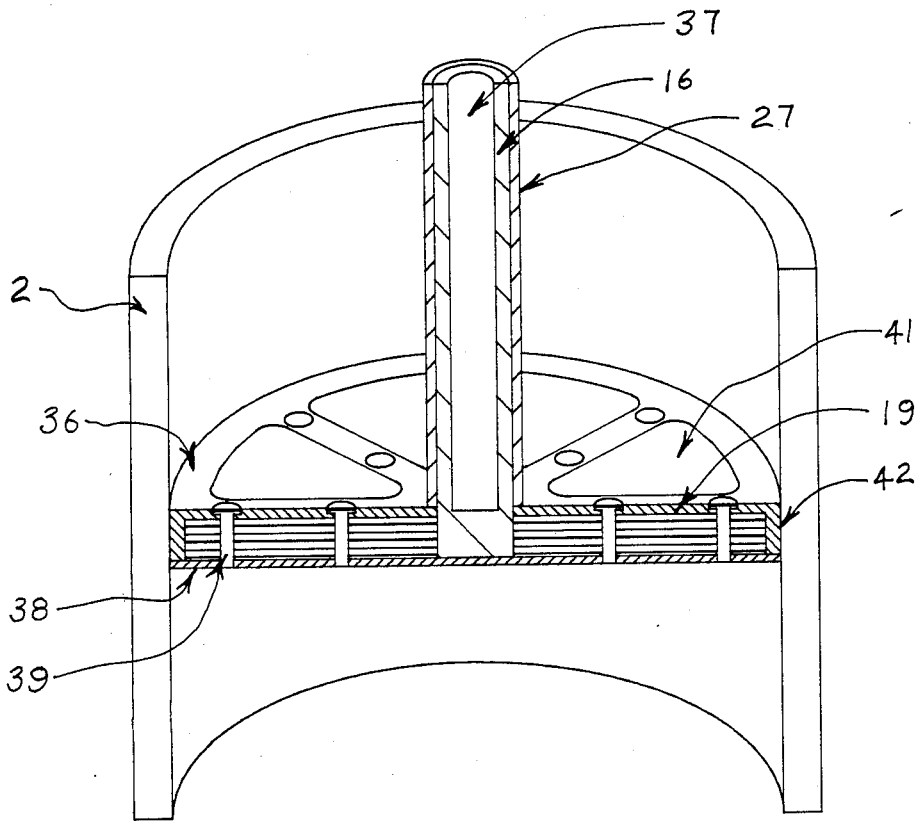
FIG. 13 is a schematic representation of a regenerator having a core of ceramic fabric of woven fibers, an auxiliary supporting structure, and a close circumferential fit to the cylinder wall.

Now referring to FIGS. 12 and 13, details of two representative regenerators are presented. The regenerator shown in FIG. 12 consists of a core (20) and an auxiliary supporting structure (19).

This auxiliary supporting structure consists of an upper, cold side perforated disk (8), a hot side core support (36), and a cylindrical skirt (9). Together, these components (8, 9, and 36) form the auxiliary supporting structure (19) which completely encloses the regenerator core (20). The regenerator is moved by the drive rod (16) which is attached to the auxiliary supporting structure. The regenerator auxiliary supporting structure (19) is equipped with a conventional labyrinth seal in the cylindrical skirt (9) to prevent or minimize the leakage of gases around the periphery of the regenerator. The regenerator core (20) consists of one or more layers of felt composed of high temperature resistant ceramic fibers. The hot side core support (36) is composed of a perforated ceramic board.

The regenerator shown in FIG. 13 has a core (20) and an auxiliary supporting structure (19). This auxiliary supporting structure is composed of a cold side core support (38), a hot side core support (36), a circumferential skirt (9), and support rods (39). The core is composed of layers of ceramic fibers in the form of screens or loosely woven fabrics. The hot side core support (36) has large flow openings (41) to permit unobstructed flow through the regenerator core (20). The cold side support (38) has similar flow openings. The hot side core support (36) is also equipped with holes and recessed (countersunk) areas on the upper surface through which the support rods (39) pass. The upper ends of these support rods have a larger diameter section or "head" which fits into the recessed areas of the regenerator hot side core support (36). A thermal barrier or cover (40) consisting of a layer of zirconia or other ceramic is attached to the upper end of each support rod (39) to protect them from the hot combustion environment. The outer circumferential skirt (9) has no special sealing mechanism with which to seal against the wall of the cylinder (2). Instead, the shell (9) and cylinder (2) are designed and fabricated with a small annular clearance (42) between them. The regenerator drive rod (16) must also be protected from the hot environment to which it is exposed. This is accomplished by a thin ceramic barrier (27) on the outer surface of the drive rod (16), and by internal cooling through the drive rod coolant space (37) located within the drive rod (16). This cooling can be accomplished by using liquid sodium coolant in a manner similar to conventional sodium cooled exhaust valves, by utilizing an appropriate liquid to cool the rod in the manner of a heat pipe, or by simply flowing coolant through the coolant space (37).

The regenerator core (20) is made of a porous heat absorbing material which must be compatible with the temperature level imposed, and the oxidizing atmosphere. For example, for temperatures less than 2000 degrees Fahrenheit, it can be fabricated from refractory metals such as nichrome or tantalum or columbium with an oxidation resistant coating. For temperatures higher than this, refractory ceramics such as alumina, zirconia, ceria or thoria are more appropriate. The regenerator core (20) must contain a large number of fine pores or passages or solid heat transfer elements having small dimensions in order to permit the passage of the air and combustion products, and to promote rapid heat transfer. The surface area of these passages should be maximized, to enhance local heat transfer, while their volume should be minimized. The regenerator operates with a temperature gradient across its core (20) which is determined largely by the temperatures of the gases which flow into it. The cold side surface of the regenerator is at a temperature near that of the compressed fresh air which is flowed into it near the end of each compression stroke. The hot side surface of the regenerator is at a temperature near that of the hot combustion products which flow into it near the end of each expansion stroke. In operation the cold flow or hot flow alternately passes through the regenerator core (1), transferring heat from or to the regenerator core material and establishing an axial temperature profile or thermocline through the regenerator core (1). The regenerator core may consist of a solid monolithic material perforated with small axial holes, or it may be laminated from multiple layers of woven screen or fabric, or it may be rolled up like a "jellyroll" or spiral of crimped metal foil. Other structures include felted mats of refractory fibers which may be either unbonded or bonded into a coherent mass by thermal sintering or by the application of dissolved or colloidally suspended refractory binders.

Examples of other regenerator core materials and constructions are presented in FIGS. 12 and 13. To prevent the accumulation of carbonaceous residues in the regenerator pores, oxidation catalysts can be used either as coatings or as the principal materials of construction. Ceria, alumina, and the oxides of iron, nickel, chromium, manganese, tungsten and copper can be employed for this purpose. In place of the regenerator drive rod (16), other means can be employed to move the regenerator at the appropriate time during the operating cycle. For example, an annular sleeve with an outer diameter slightly less than the cylinder inner diameter could be employed. Also, the regenerator drive rod could pass through the piston (1) rather than the cylinder head (6).

For some regenerator core materials, it may be unnecessary to completely enclose the core with an auxiliary supporting structure. In some cases it may even by possible to eliminate the auxiliary supporting structure (19) entirely and to fasten the core (20) directly to the regenerator drive rod (16). If the regenerator has an auxiliary supporting structure (19), this structure must also be capable of withstanding its working environment. Any part of the auxiliary supporting structure that is in, on, or near the hot end of the regenerator must be composed of a material which retains its strength at high temperatures, or it must be cooled or insulated or both. Such cooling can be provided by conduction of heat through other portions of the auxiliary supporting structure, or the driving mechanism, or by other means. In addition to its structural function, the auxiliary supporting structure is utilized to minimize leakage of the working fluid around the periphery of the regenerator. In addition to the labyrinth seal (35) and the close circumferential fit (42) shown in FIGS. 12 and 13 respectively, other sealing means, such as conventional piston rings, can be employed.

All internal combustion engines operate by alternately compressing and expanding a gas. In order to produce positive net work from the cycle, the gas must be colder (and hence at a lower pressure) when it is being compressed and hotter (and hence at a higher pressure) when it is being expanded. In a conventional Otto or Diesel engine the necessary change in temperature is provided by the combustion of fuel with air, and thus the timing of the ingnition or injection relative to the motion of the piston is important in determining the power output.

In an engine equipped with a movable permeable regenerator, the heating and cooling of the gas is determined by the motion of the regenerator relative to the gas, and this becomes the important parameter. One of the very important aspects affecting the correct regenerator motion is the non-linearity of its effect. For example, consider an engine with a regenerator whose hot end temperature is ten times the cold end temperature (on an absolute temperature scale). When the regenerator is moved from one end of the gas volume to the other, so as to increase the temperature of the gas which passes through the regenerator by a factor of ten, then the pressure of the gas will also rise by a factor of ten. Application of the gas laws to this situation shows that the pressure rises slowly during the early part of the regenerator motion, but very rapidly during the final part, as the regenernator approaches the end of its stroke. Roughly half of the total pressure rise occurs during the last ten percent of the regenerator motion. It follows from this heat the motion of the regenerator through the last few percent of the cold gas volume is very important if the engine is to produce high gas pressure, high torque and high power. If the engine configurations illustrated in FIGS. 1 and 6 are compared, it may be seen that the regenerator can sweep through all of the gas volume in the engine of FIG. 1, but cannot sweep through the volumes between the intake and exhaust valves and the cylinder (i.e. the valve clearance volumes) and the gas flow passage volume in the engine of FIG. 6. Thus the engine of FIG. 1 will be superior in power. All these volumes should be minimized. Similarly, if the internal gas volume of the regenerator is excessive, and if this excessive internal gas volume is at the cold end of the regenerator, this will reduce the mean effective pressure and specific power output of the engine.

The ideal regenerator motion from a thermodynamic standpoint is to move the regenerator instantly in the direction which will heat the gas at the completion of the piston compression stroke, to keep it in this relative position throughout the piston expansion stroke, and to move it instantly in the direction which will cool the gas at the end of the expansion stroke. The invention disclosed herein employs a movable regenerator whose motion can approach this ideal regenerator motion. However instantaneous motions are not possible in a real engine, because of the excessive acceleration forces and stresses which would be required. The regenerator motion can be provided by conventional means such as cams, pushrods, rocker arms, belts, chains, and combinations of these, driven by the crankshaft. Such means can be very similar to those employed to open and close valves on conventional gasoline and Diesel engines. These regenerator drive mechanisms must provide a compromise between the optimum thermodynamic requirements of instantaneous motion and the material and structural limitations of the regenerator.

Obviously, many modifications and variations of the present invention are possible in light of the above teachings. It is therefore understood that, within the scope of the appended claims, the invention may be practiced otherwise than as specifically described.

We claim:

1. In a thermally regenerated reciprocating cyclic internal combustion engine having a rotating power output shaft composed of a number of similar working units, each working unit comprising (1) a cylinder closed at one end by a cylinder head, with a number of intake valves to draw cool fresh air into the cylinder, and a number of exhaust valves to exhaust the spent combustion gases from the cylinder; (2) a first means for opening and closing said intake and exhaust valves in a predetermined manner once in each engine cycle; (3) a piston inside the cylinder moving along the axis of the cylinder in a reciprocating manner toward and away from the cylinder head between the top dead center position closest to the cylinder head and the bottom dead center position furthest away from the cylinder head, said piston being connected to the power output shaft by a second means which translates the reciprocating motion of said piston to rotation of the power output shaft; (4) a thermal regenerator inside the cylinder between the cylinder head and the piston, capable of being moved in predetermined cyclic reciprocating motion along the axis of the cylinder and comprising a permeable core and other structure, to absorb heat from the hot combustion gases when moved in one direction, and to transfer the absorbed heat to the cool fresh air when moved in the opposite direction; (5) a third means for imparting a predetermined periodic motion to said thermal regenerator; (6) an injection means for injecting combustible fuel into the cylinder; and (7) an ignition means for igniting the mixture of said air and said fuel in the cylinder:

the thermal regenerator in which the permeable core comprises multiple layers of fabric woven from high temperature resistant ceramic fiber yarn.

2. In a thermally regenerated reciprocating cyclic internal combustion engine having a rotating power output shaft composed of a number of similar working units, each working unit comprising (1) a cylinder closed at one end by a cylinder head, with a number of intake valves to draw cool fresh air into the cylinder, and a number of exhaust valves to exhaust the spent combustion gases from the cylinder; (2) a first means for opening and closing said intake and exhaust valves in a predetermined manner once in each engine cycle; (3) a piston inside the cylinder moving along the axis of the cylinder in a reciprocating manner toward and away from the cylinder head between the top dead center position closest to the cylinder head and the bottom dead center position furthest away from the cylinder head, said piston being connected to the power output shaft by a second means which translates the reciprocating motion of said piston to rotation of the power output shaft; (4) a thermal regenerator inside the cylinder between the cylinder heat and the piston, capable of being moved in predetermined cyclic reciprocating motion along the axis of the cylinder and comprising a permeable core and a cylindrical skirt for structural strength, for reducing gas flow around the regenerator and for providing a bearing surface against the cylinder wall, to absorb heat from the hot combustion gases when moved in one direction, and to transfer the absorbed heat to the cool fresh air when moved in the opposite direction; (5) a third means for imparting a predetermined periodic motion to said thermal regenerator; (6) an injection means for injecting combustible fuel into the cylinder; and (7) an ignition means for igniting the mixture of said air and said fuel in the cylinder:

the thermal regenerator in which the cylindrical skirt seals apainst the cylinder wall by means of multiple grooves and lands formed in its outer surface.

3. In a thermally regenerated reciprocating cyclic internal combustion engine having a rotating power output shaft composed of a number of similar working units, each working unit comprising (1) a cylinder closed at one end by a cylinder head, with a number of intake valves to draw cool fresh air into the cylinder, and a number of exhaust valves to exhaust the spent combustion gases from the cylinder: (2) a first means for opening and closing said intake and exhaust valves in a predetermined manner once in each engine cycle; (3) a piston inside the cylinder moving along the acis of the cylinder in a reciprocating manner toward and away from the cylinder head between the top dead center position closest to the cylinder head and the bottom dead center position furthest away from the cylinder head, said piston being connected to the power output shaft by a second means which translates the reciprocating motion of said piston to rotation of the power output shaft; (4) a thermal regenerator inside the cylinder between the cylinder head and the piston, capable of being moved in predetermined cyclic reciprocating motion along the axis of the cylinder and comprising a permeable core and a cylindrical skirt for structural strength, for reducing gas flow around the regenerator and for providing a bearing surface against the cylinder wall, to absorb heat from the hot combustion gases when moved in one direction, and to transfer the absorbed heat to the cool fresh air when moved in the opposite direction; (5) a third means for imparting a predetermined periodic motion to said thermal regenerator; (6) an injection means for injecting combustible fuel into the cylinder; and (7) an ignition means for igniting the mixture of said air and said fuel in the cylinder:

the thermal regenerator in which the cylindrical skirt seals against the cylinder wall by means of a close fitting groove in its outer surface which holds an elastic ring which presses lightly against the cylinder wall.

* * * * *